US010428609B2

(12) United States Patent
Farrar et al.

(10) Patent No.: US 10,428,609 B2
(45) Date of Patent: Oct. 1, 2019

(54) DOWNHOLE TOOL ACTUATION SYSTEM HAVING INDEXING MECHANISM AND METHOD

(71) Applicants: Benjamin J. Farrar, Cypress, TX (US); Hector H. Mireles, Jr., Spring, TX (US); James A. Smith, Manvel, TX (US)

(72) Inventors: Benjamin J. Farrar, Cypress, TX (US); Hector H. Mireles, Jr., Spring, TX (US); James A. Smith, Manvel, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 323 days.

(21) Appl. No.: 15/192,502

(22) Filed: Jun. 24, 2016

(65) Prior Publication Data

US 2017/0370168 A1 Dec. 28, 2017

(51) Int. Cl.

| | |
|---|---|
| ***E21B 23/00*** | (2006.01) |
| ***E21B 23/04*** | (2006.01) |
| ***E21B 34/14*** | (2006.01) |
| ***E21B 34/10*** | (2006.01) |
| ***E21B 34/00*** | (2006.01) |

(52) U.S. Cl.

CPC ..... *E21B 23/006* (2013.01); *E21B 23/004* (2013.01); *E21B 23/04* (2013.01); *E21B 34/10* (2013.01); *E21B 34/14* (2013.01); *E21B 2034/002* (2013.01); *E21B 2034/007* (2013.01)

(58) Field of Classification Search

CPC ..... E21B 23/006; E21B 23/04; E21B 34/14; E21B 2034/007; E21B 2034/002

See application file for complete search history.

(56) References Cited

U.S. PATENT DOCUMENTS

| | | | |
|---|---|---|---|
| 5,819,854 | A | 10/1998 | Doane et al. |
| 6,230,807 | B1 | 5/2001 | Patel |
| 6,516,886 | B2 | 2/2003 | Patel |

(Continued)

OTHER PUBLICATIONS

International Search Report for International Application No. PCT/US2017/038463; dated Sep. 26, 2017; 3 pages.

(Continued)

*Primary Examiner* — David J Bagnell
*Assistant Examiner* — Jonathan Malikasim
(74) *Attorney, Agent, or Firm* — Cantor Colburn LLP

(57) ABSTRACT

A downhole tool actuation system including: a tubing having a longitudinal axis and a main flowbore supportive of tubing pressure; an indexing mechanism in fluidic communication with the main flowbore, the indexing mechanism configured to count N number of tubing pressure cycles; a port isolation device movable between a blocking condition and an actuation condition, the port isolation device in the blocking condition for N−1 cycles of the indexing mechanism, and movable to the actuation condition at the Nth cycle of the indexing mechanism; and, a chamber sealed from the main flowbore in the blocking condition of the port isolation device, the chamber exposed to the tubing pressure in the actuation condition of the port isolation device. The downhole tool actuation system is configured to actuate a downhole tool upon exposure of the chamber to tubing pressure.

22 Claims, 14 Drawing Sheets

(56) References Cited

U.S. PATENT DOCUMENTS

| | | | |
|---|---|---|---|
| 6,659,186 | B2 | 12/2003 | Patel |
| 6,662,877 | B2 | 12/2003 | Patel |
| 6,945,331 | B2 | 9/2005 | Patel |
| 7,216,713 | B2 | 5/2007 | Read, Jr. |
| 7,303,020 | B2 | 12/2007 | Bishop et al. |
| 7,748,461 | B2 | 7/2010 | Loretz et al. |
| 7,775,283 | B2 | 8/2010 | Coronado et al. |
| 7,870,908 | B2 | 1/2011 | Mandrou |
| 7,926,573 | B2 | 4/2011 | Swan et al. |
| 7,980,316 | B2 | 7/2011 | Swenson |
| 8,006,768 | B2 | 8/2011 | Powell et al. |
| 8,151,887 | B2 | 4/2012 | Dcosta et al. |
| 8,225,871 | B2 | 7/2012 | Beall et al. |
| 8,256,518 | B2 | 9/2012 | Guven et al. |
| 8,272,443 | B2 | 9/2012 | Watson et al. |
| 8,365,832 | B2 | 2/2013 | Martin et al. |
| 8,403,063 | B2 | 3/2013 | Derek et al. |
| 8,596,365 | B2 | 12/2013 | Frosell |
| 8,602,105 | B2 | 12/2013 | Sinclair |
| 8,607,882 | B2 | 12/2013 | Kalb et al. |
| 8,684,099 | B2 | 4/2014 | Azimi et al. |
| 8,757,273 | B2 | 6/2014 | Themig et al. |
| 8,776,890 | B2 | 7/2014 | Basmajian et al. |
| 8,931,565 | B2 | 1/2015 | Desranleau et al. |
| 9,068,417 | B2 | 6/2015 | Swenson et al. |
| 9,133,684 | B2 | 9/2015 | Hofman et al. |
| 9,187,991 | B2 | 11/2015 | Fripp et al. |
| 9,206,669 | B2 | 12/2015 | Holderman |
| 9,267,345 | B2 | 2/2016 | Grande et al. |
| 9,309,745 | B2 * | 4/2016 | Patel ..... E21B 34/10 |
| 9,316,088 | B2 | 4/2016 | Reid et al. |
| 9,328,579 | B2 | 5/2016 | Wilson |
| 9,334,710 | B2 | 5/2016 | Pacey et al. |
| 9,359,865 | B2 | 6/2016 | Mailand et al. |
| 9,752,412 | B2 * | 9/2017 | Shkurti ..... E21B 34/063 |
| 2006/0169462 | A1 | 8/2006 | Bishop et al. |
| 2009/0050335 | A1 | 2/2009 | Mandrou |
| 2009/0308588 | A1 * | 12/2009 | Howell ..... E21B 21/103 166/66.4 |
| 2012/0267119 | A1 | 10/2012 | Patel |
| 2013/0092380 | A1 * | 4/2013 | Reid ..... E21B 23/00 166/316 |
| 2013/0299199 | A1 | 11/2013 | Naedler et al. |
| 2014/0102703 | A1 | 4/2014 | Mailand et al. |
| 2014/0158433 | A1 | 6/2014 | Bisset |
| 2014/0246208 | A1 | 9/2014 | Themig et al. |
| 2015/0041148 | A1 | 2/2015 | Greenan |
| 2015/0292281 | A1 | 10/2015 | Hardin et al. |
| 2016/0003005 | A1 | 1/2016 | Pickle et al. |
| 2016/0090815 | A1 | 3/2016 | Kennedy |
| 2018/0187501 | A1 * | 7/2018 | van Petegem ..... E21B 41/00 |

OTHER PUBLICATIONS

Written Opinion of the International Search Report for International Application No. PCT/US2017/038463; dated Sep. 26, 2017; 8 pages.

"Vault Barrier Valves—Ensure reliable sealing and reduce costs", 2015, Baker Hughes Incorporated; bakerhughes.com; 4 pages.

* cited by examiner

DOWNHOLE TOOL ACTUATION SYSTEM HAVING INDEXING MECHANISM AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Different types of downhole tools, such as valves, packers, sleeves, and other flow control devices, are required to effectively complete the well. In downhole tools, the use of hydraulic pressure to activate features is known, in which case the downhole tools are activatable using a specific pressure. To avoid setting or actuating the downhole tools prematurely, the downhole tools may be physically isolated from other downhole tools that are receiving pressure, such as through the use of dropped balls. The downhole tools may additionally or alternatively include an electronic trigger that can be provided with a timing function. Alternatively, materials may be employed that dissolve when exposed to wellbore fluids or rupture disks can be incorporated in the design.

The art would be receptive to alternative systems and methods to actuate a downhole tool.

BRIEF DESCRIPTION

A downhole tool actuation system including: a tubing having a longitudinal axis and a main flowbore supportive of tubing pressure; an indexing mechanism in fluidic communication with the main flowbore, the indexing mechanism configured to count N number of tubing pressure cycles; a port isolation device movable between a blocking condition and an actuation condition, the port isolation device in the blocking condition for N−1 cycles of the indexing mechanism, and movable to the actuation condition at the Nth cycle of the indexing mechanism; and, a chamber sealed from the main flowbore in the blocking condition of the port isolation device, the chamber exposed to the tubing pressure in the actuation condition of the port isolation device. The downhole tool actuation system is configured to actuate a downhole tool upon exposure of the chamber to tubing pressure.

A method of actuating a downhole tool associated with a tubing includes: arranging the downhole tool in operative engagement with a chamber; isolating the chamber from tubing pressure for N−1 pressure cycles in the tubing; and, during an Nth pressure cycle in the tubing, exposing the chamber to tubing pressure, wherein exposure of the chamber to tubing pressure is configured to actuate the downhole tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
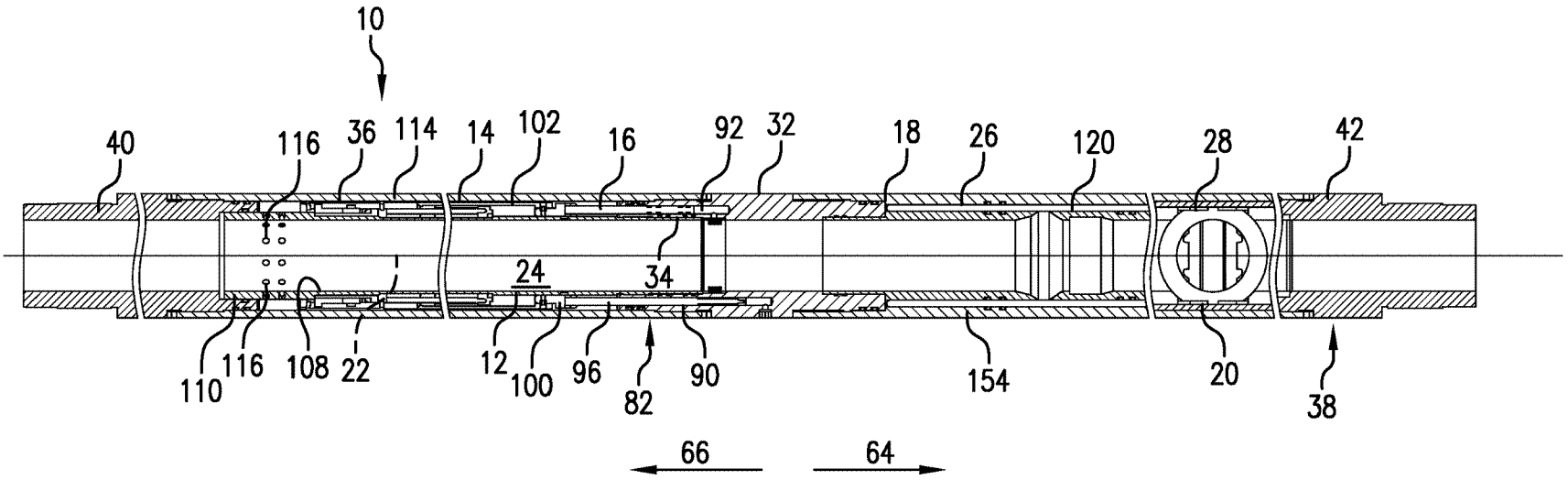
FIG. 1A depicts a sectional view of one embodiment of a downhole tool actuation system including one embodiment of a downhole tool in a closed condition.
Figure 1B:
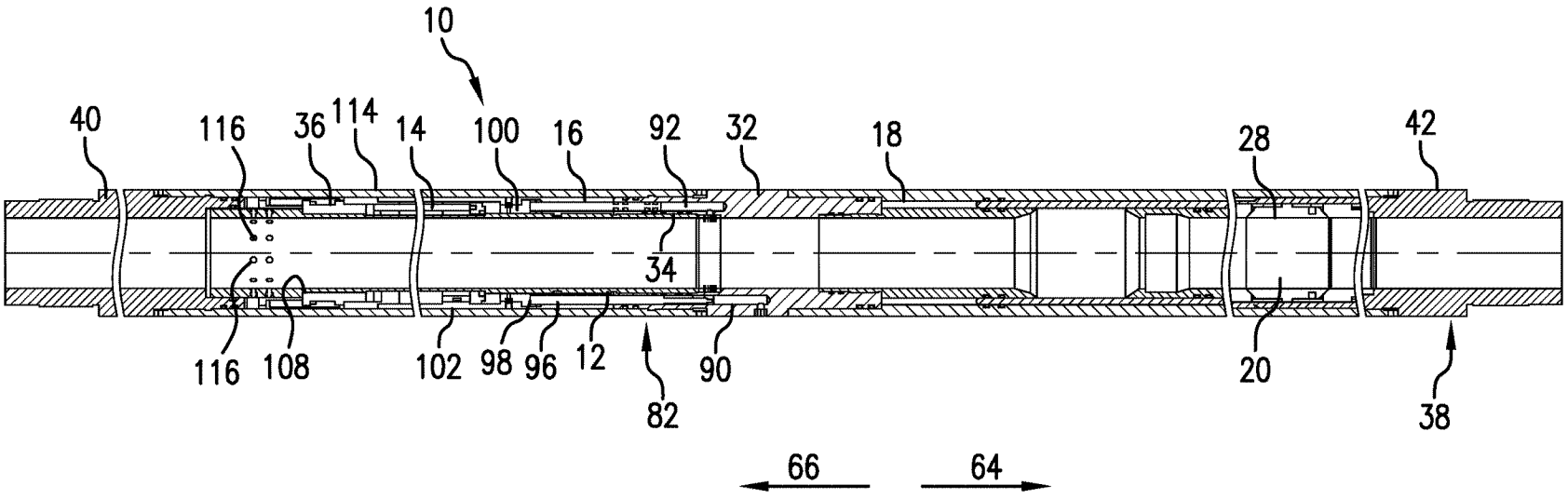
FIG. 1B depicts a sectional view of the downhole tool actuation system of FIG. 1 with the downhole tool in an open condition.

With initial reference to FIGS. 1A and 1B embodiments of a downhole tool actuation system 10 include, in part, a tubing 12, an indexing mechanism 14, a port isolation device 16, a chamber 18, and a downhole tool 20. The tubing 12 has a longitudinal axis 22 and an interior/main flowbore 24 supportive of tubing pressure. The indexing mechanism 14 is in fluidic communication with the main flowbore 24 and is configured to count a set number of tubing pressure cycles within the tubing 12. The port isolation device 16 is movable between a blocking condition and an actuation condition. The port isolation device 16 is in the blocking condition until the last cycle of the indexing mechanism 14, at which point the port isolation device 16 is moved to the actuation condition. The chamber 18 is sealed from the main flowbore 24 in the blocking condition of the isolation device 16, and exposed to the tubing pressure in the actuation condition of the port isolation device 16. Exposure of the chamber 18 to tubing pressure is configured to actuate the downhole tool 20, such as by moving a piston 26 with the tubing pressure in the chamber 18. The chamber 18 has a smaller size in the blocking condition of the port isolation device 16 than in the actuation condition of the port isolation device 16. That is, as tubing pressure fills the chamber 18, the chamber 18 will expand as the piston 26 is moved. The chamber 18 may be at atmospheric pressure in the blocking condition of the port isolation device 16, or may contain or be pre-charged with an alternative pressure, such that during the blocking condition, the pressure contained within the chamber 18 is insufficient to move the piston 26.

Figure 11:
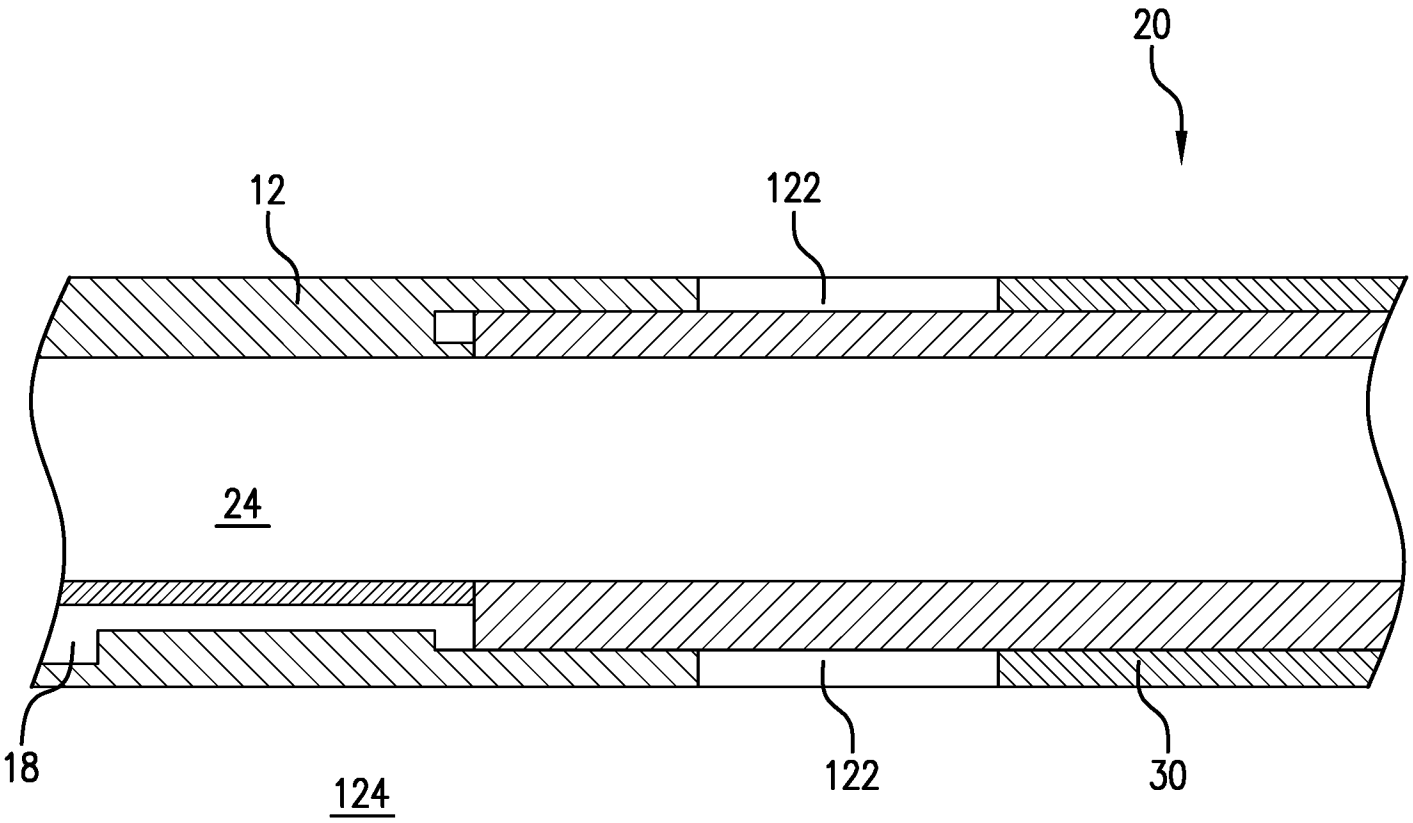
FIG. 11 depicts a schematic view of another embodiment of a downhole tool for use with the embodiments of the downhole tool actuation systems.

Embodiments of the downhole tool actuation system 10 enable a method of isolating and then energizing the chamber 18, which, when flooded by pressure (hydraulic fluid pressure), acts on the piston 26 to activate a feature in the down hole tool 20. Although the downhole tool 20 could be various tools such as, but not limited to, a ball valve 28 (FIGS. 1A-1B), a sleeve valve 30 (FIG. 11), an injection valve and other flow control valves, a setting device such as a packer, an actuatable plug or movable barrier, and other tools needed to complete a well. In the embodiment shown in FIGS. 1A and 1B, the downhole tool is a ball valve 28 and the piston 26 will be energized with hydraulic tubing pressure to remotely open the closed ball valve 28 (FIG. 1A) in a borehole, but this method could be used in any other application where a chamber 18 must be isolated during operations of completing the well and then energized by hydraulic pressure to activate the feature of the tool 20 on demand. The downhole tool actuation system 10 incorporates a port isolation sub 32 or body with the communication port 34 to the chamber 18 in the tool 20. The isolation device 16 will prevent hydraulic pressure from entering the port 34 while in the isolation position (blocking condition) and the indexing mechanism 14 provides means of uncovering the port 34 at a desired time which will allow hydraulic pressure into the port 34. While the illustrated indexing mechanism 14 includes embodiments of a ratcheting arrangement 36, alternatively the indexing mechanism 14 can incorporate a J-Slot, ratchet with angled faces or other counter to maintain the isolation device 16 in the isolation position (blocking condition), preventing pressure communication to the port 34, until a pre-determined number of tubing pressure cycles applied in the tubing 12 allows the isolation device 16 to be repositioned from the isolating position (a blocking condition) as shown in FIG. 1A to a position that allows hydraulic pressure communication into the port 34 and into the chamber 18 (an actuation condition) to actuate the downhole tool 20 as shown in FIG. 1B.

Figure 2:
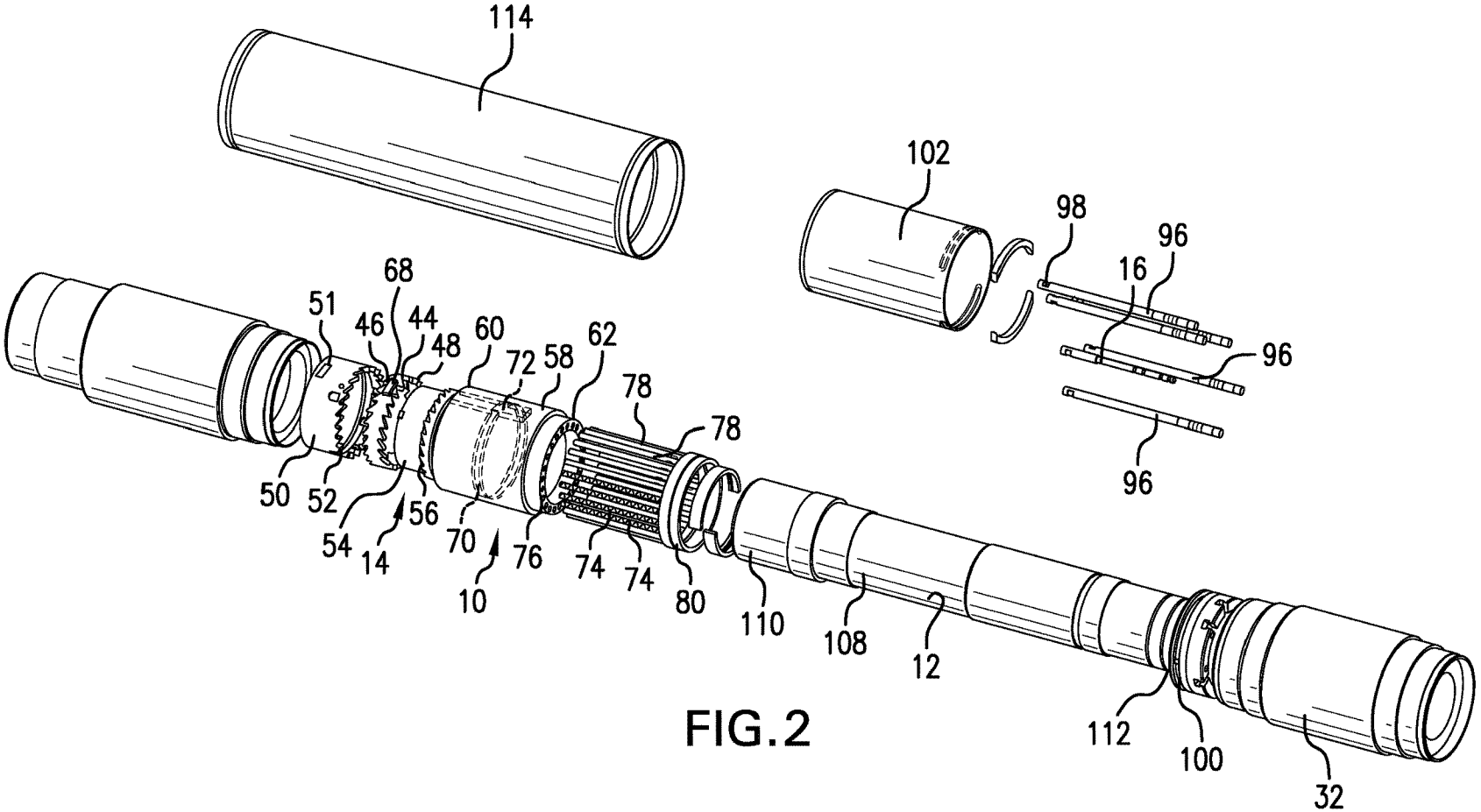
FIG. 2 depicts an exploded view of portions of the downhole tool actuation system of FIGS. 1A-1B.
Figure 3A:
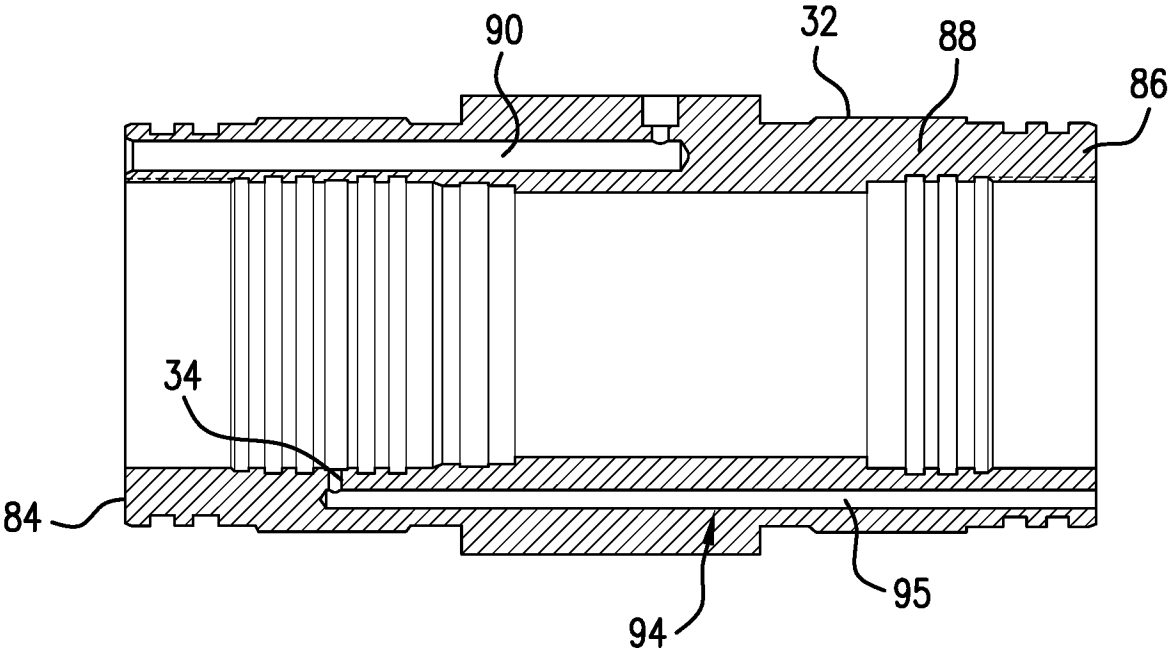
FIG. 3A depicts a sectional view of one embodiment of a port isolation sub for the downhole tool actuation system of FIGS. 1A-1B.
Figure 3B:
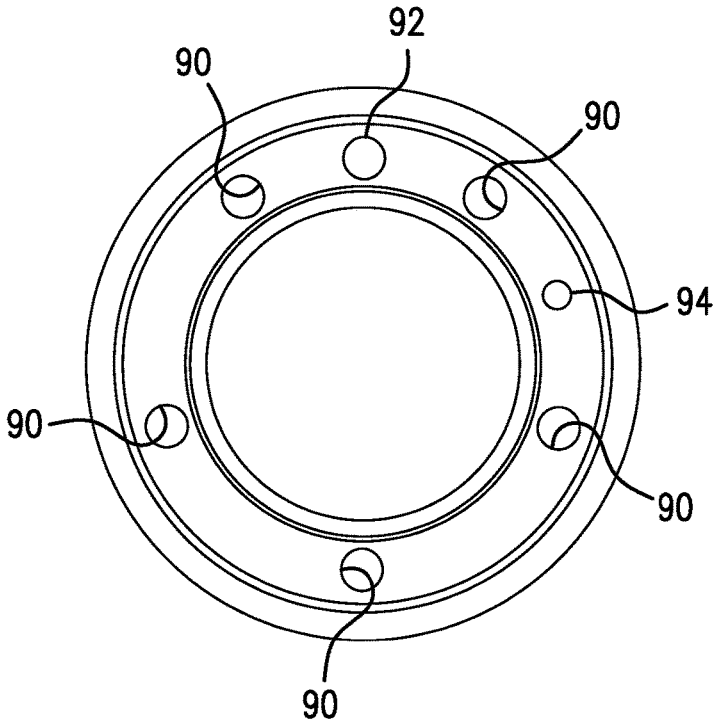
FIG. 3B depicts an axial end view of the port isolation sub of FIG. 3A

With further reference to FIGS. 1A-1B, and additional reference to FIGS. 2 and 3, features of one embodiment of the downhole tool actuation system 10 will now be described in further detail. The downhole tool actuation system 10 forms part of a tubing string 38 configured to be run into a borehole, which may be cased or open (uncased). The tubing string 38 may include any number of tubing joints and tools connected together to form the tubing string 38. An uphole end of the downhole tool actuation system 10 is connected to a first sub 40 (an uphole sub), and a downhole end of the downhole tool actuation system 10 is connected to a second sub 42 (a downhole sub). The first and second subs 40, 42 may connect the system 10 to other tools, tubing joints, and blanks positioned uphole and downhole thereof, respectively.

The indexing mechanism 14 includes, in one embodiment, the ratcheting arrangement 36. The ratcheting arrangement 36 includes a rotatable ratchet 44 having a first (uphole) ratchet face 46 and a second (downhole) ratchet face 48. The ratcheting arrangement 36 further includes a first (uphole) fixed ratchet 50 having a third ratchet face 52, and a second (downhole) fixed ratchet 54 having a fourth ratchet face 56. The ratcheting arrangement 36 further includes a rotationally locked ratchet housing 58 having a first end 60 and a longitudinally spaced second end 62. The first and second fixed ratchets 50, 54 are rotationally locked as well. The ratcheting arrangement 36 shares the longitudinal axis 22 with the system 10, and the rotatable ratchet 44 will partially rotate, with each cycle, about the longitudinal axis 22 as it strokes in a downhole direction 64 (in response to increased tubing pressure) to contact the second fixed ratchet 54. Engagement of the second ratchet face 48 with the fourth ratchet face 56 will rotate the rotatable ratchet 44 due to the engaging surfaces. As the rotatable ratchet 44 returns in the uphole direction 66 (as pressure in the tubing 12 is bled off), the rotatable ratchet 44 will rotate again due to engagement of the first ratchet face 46 with the third ratchet face 52 of the first fixed ratchet 50, thus completing a cycle of the indexing mechanism 14.

The ratchet housing 58 will move a first distance X (FIG. 4B) longitudinally with the rotatable ratchet 44 as the rotatable ratchet 44 strokes between the first and second fixed ratchets 50, 54. A restrainment device, such as a lug 68 (see FIGS. 5A-5D), is provided to prevent the indexing mechanism 14 from moving a second distance Y (FIG. 4D) greater than the first distance X until a final cycle of the indexing mechanism 14. The lug 68 is provided on an outer surface of the rotatable ratchet 44 and is aligned with a circumferential groove 70 on an inner surface of the ratchet housing 58. The lug 68 positioned in the groove 70 longitudinally traps the ratchet housing 58 from moving longitudinally a greater distance than that which the rotatable ratchet 44 moves between the first and second fixed ratchets 50, 54. As the ratchet housing 58 moves longitudinally in opposing uphole and downhole directions 66, 64 as a result of changing tubing pressure, the ratchet housing 58 will carry the rotatable ratchet 44 between the first and second fixed ratchets 50, 54. The rotatable ratchet 44 can also rotate inside the ratchet housing 58, via the inner circumferential groove 70. That is, when the ratchet housing 58 moves the rotatable ratchet 44 into contact with the second fixed ratchet 54, the rotatable ratchet 44 will be forced to rotate within the groove 70 of the ratchet housing 58 due to the engagement of faces 48, 56, and then when the ratchet housing 58 carries ratchet 44 back up and into engagement with the first fixed ratchet 50, the ratchet 44 will further rotate within the groove 70 when it contacts the first fixed ratchet 50.

The ratchet housing 58 further includes a longitudinal slot or groove 72 which may align with a protrusion 51 on the first fixed ratchet 50 for the purpose of maintaining the ratchet housing 58 straight (longitudinally aligned) during longitudinal movement of the ratchet housing 58, and to ensure that the ratchet housing 58 does not rotate. The length of the longitudinal groove 72 enables movement of the ratchet housing 58 the second distance Y greater than the first distance X when the indexing mechanism 14 has reached a final cycle. Once the rotatable ratchet 44 has rotated the set number of cycles, the lug 68 of the rotatable ratchet 44 rotates into alignment with the longitudinal groove 72. At this time, the ratchet housing 58 is able to move further with respect to the tubing 12 to move the isolation device 16 to the second condition, as will be further described below.

A biasing device, such as one or more springs 74 is provided between the second end 62 of the ratchet housing 58 and a stop surface such as rod housing 80. In this particular embodiment, the biasing device 74 biases in the uphole direction 66, such that when increasing tubing pressure, the biasing device 74 is compressed against its bias as the ratchet housing 58 moves in the downhole direction 64, and when pressure is bled off, the springs 74 decompress and push the ratchet housing 58 back in the uphole direction 66, to push the rotatable ratchet 44 up into the first fixed ratchet 50. For example, in one embodiment, at the second end 62 of the ratchet housing 58, a plurality of holes 76 (FIG. 2), extending substantially longitudinally parallel with the longitudinal axis 22, may be provided in the wall of the ratchet housing 58 for receiving spring centralizer rods 78 therein. The rod housing 80 accepts the opposing ends of each of the spring centralizer rods 78. Springs 74 are provided on an exterior of each the rods 78 and the springs 74 will be compressible between the ratchet housing 58 and an end of the rod housing 80. A longitudinal position of the rod housing 80 with respect to the tubing 12 may be fixed, and the ratchet housing 58 will move with respect to the rod housing 80. While a plurality of springs 74 are utilized in the embodiment of the system 10 shown, alternatively, a single larger spring, concentric with the longitudinal axis 22, may be provided in lieu of the individual smaller springs 74, however, a larger spring may be more expensive.

The isolation device 16 may be provided in the port isolation sub 32 as part of a port isolation assembly 82. The port isolation sub 32 is the part of the system 10 where tubing pressure is prevented from getting to the chamber 18 throughout N−1 pressure cycles, and the part of the system 10 where tubing pressure is communicated to the chamber 18 when the indexing mechanism 14 has counted N number of cycles. The port isolation sub 32 includes a first end 84 and a second end 86. The port isolation sub 32 includes a wall 88 having a plurality of longitudinal piston rod apertures 90 extending from the first end 84 and partially into the sub 32. A port isolation aperture 92 longitudinally formed within the wall 88 is configured to support the port isolation device 16 therein. The chamber 18 is located adjacent the second end 86 of the port isolation sub 32. A fluidic passageway 94 is provided in the wall 88 of the sub 32 to fluidically communicate the chamber 18 with the port isolation aperture 92. The fluidic passageway 94 includes the radial communication port 34 in the port isolation sub 32 that fluidically connects to the port isolation aperture 92, and a longitudinal pathway 95 that fluidically connects the radial communication port 34 to the chamber 18. The port, isolation aperture 92 and the longitudinal pathway 95 are depicted separately in FIGS. 1A-1B and FIG. 3 due to the rotation of where the sectional view is taken.

A plurality of piston rods 96 are respectively provided within each of the piston rod apertures 90. The isolation device 16 may also be mandrel or piston-shaped as shown, such that the isolation device 16 functions as a port isolation piston. The piston rods 96 may have a longer or shorter length than the port isolation device 16. First ends 98 of the piston rods 96 and the port isolation device 16 are supported by a piston ring 100 (as best shown in FIGS. 5A-5D). While the port isolation sub 32 is fixed longitudinally with respect to the tubing 12, the piston ring 100 is longitudinally movable with respect to the tubing 12 and the port isolation sub 32. Thus, tubing pressuring which is accessible to the indexing mechanism 14 will move the piston ring 100 and attached piston rods 96 and the port isolation device 16 in a downhole direction 64 upon receipt of increased tubing pressure. The piston ring 100 may be connected to a spring housing 102, which in turn is connected to the ratchet housing 58. Thus, downhole movement of the piston ring 100 will translate to downhole movement of the ratchet housing 58 (and rotation of the rotatable ratchet 44). When the pressure is bled off to decrease the tubing pressure, the biasing device/spring(s) 74 will move the ratchet housing 58 in the uphole direction 66 which in turn will draw the piston ring 100 and connected piston rods 96 and port isolation device 16 back in the uphole direction 66.

The port isolation device 16 includes a plurality of grooves for supporting seals 104 (FIG. 4D) thereon. In the blocked condition of the port isolation device 16, at least one seal 104 is disposed uphole the radial communication port 34 and at least one seal 104 is disposed downhole the port 34, such that tubing pressure is blocked from accessing the fluidic passageway 94 and chamber 18. In the actuation condition of the port isolation device 16, the seals 104 are on a same side (such as the uphole side) of the radial port 34, and tubing pressure is communicated to the fluidic passageway 94 and chamber 18. In the illustrated embodiment, the port isolation device 16 includes four grooves, each supporting a seal 104 between the port isolation device 16 and the port isolation aperture 92. The number of seal grooves can be increased or decreased depending on the type of seal used. During N−1 cycles of the indexing mechanism 14, the port isolation device 16 moves longitudinally in uphole and downhole directions 66, 64 with the piston ring 100, but the seals 104 on the port isolation device 16 continue to straddle the port 34 and thereby restrict the tubing pressure from accessing the port 34 and fluidic passageway 94 to the chamber 18. However, on the Nth cycle, as the biasing device/spring(s) 74 decompresses and the ratchet housing 58 moves the second distance Y due to longitudinal alignment of the lug 68 and the longitudinal groove 72, the ratchet housing 58 and connected spring housing 102 and piston ring 100 pull the port isolation device 16 further out of the port isolation aperture 92 such that tubing pressure (hydrostatic pressure) is allowed to enter the chamber 18.

The indexing mechanism 14 and port isolation assembly 82 form a hydraulic module 106 of the system 10. The system 10 may further include a mandrel 108 that is disposed within the hydraulic module 106. The mandrel 108 forms part of the overall tubing 12 which is supportive of tubing pressure. A first (uphole) end 110 of the mandrel 108 may be secured within the first sub 40, and a second (downhole) end 112 of the mandrel 108 may abut with a shoulder in the port isolation sub 32, such that the first sub 40, mandrel 108, the port isolation sub 32, downhole tool 20, and the second sub 42 share a same flow path. A hydraulic module housing 114 extends from the first sub 40 to the port isolation sub 32 to protect the hydraulic module 106 on the mandrel 108, and to further enclose the tubing pressure available within the hydraulic module 106 for use by the hydraulic module 106. As shown in FIGS. 1A and 1B, the mandrel 108 may be provided with radial holes 116 (FIGS. 1A-1B) to fluidically communicate tubing pressure to the hydraulic module 106. Tubing pressure will go through the holes 116 and around the mandrel 108 into the hydraulic module 106.

Figure 4A:
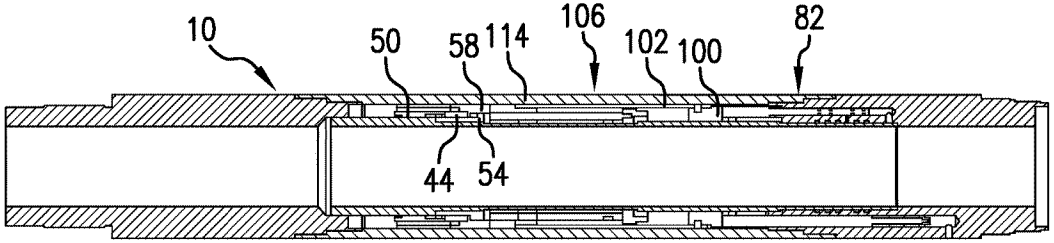
FIGS. 4A-4D depict a sectional view of portions of the downhole tool actuation system during various pressure cycles.
Figure 4B:
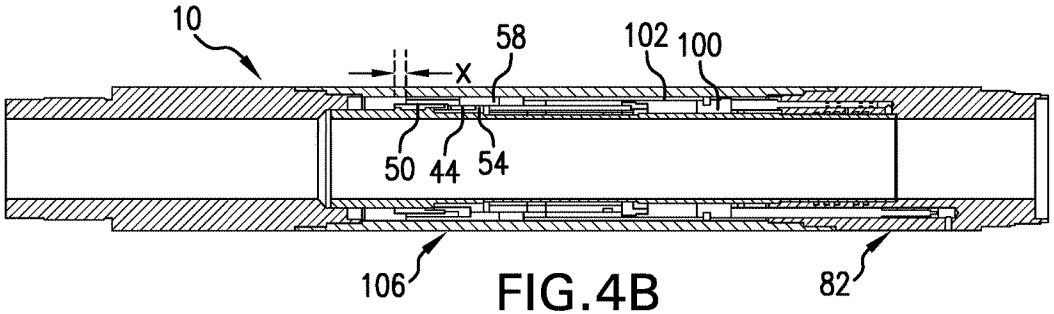
Figure 4C:
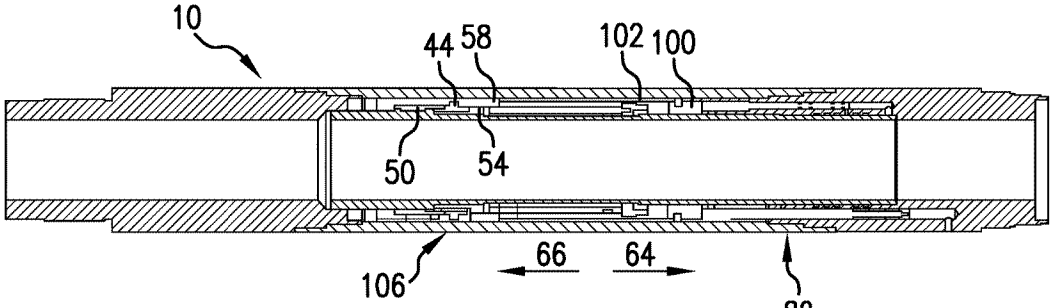
Figure 4D:
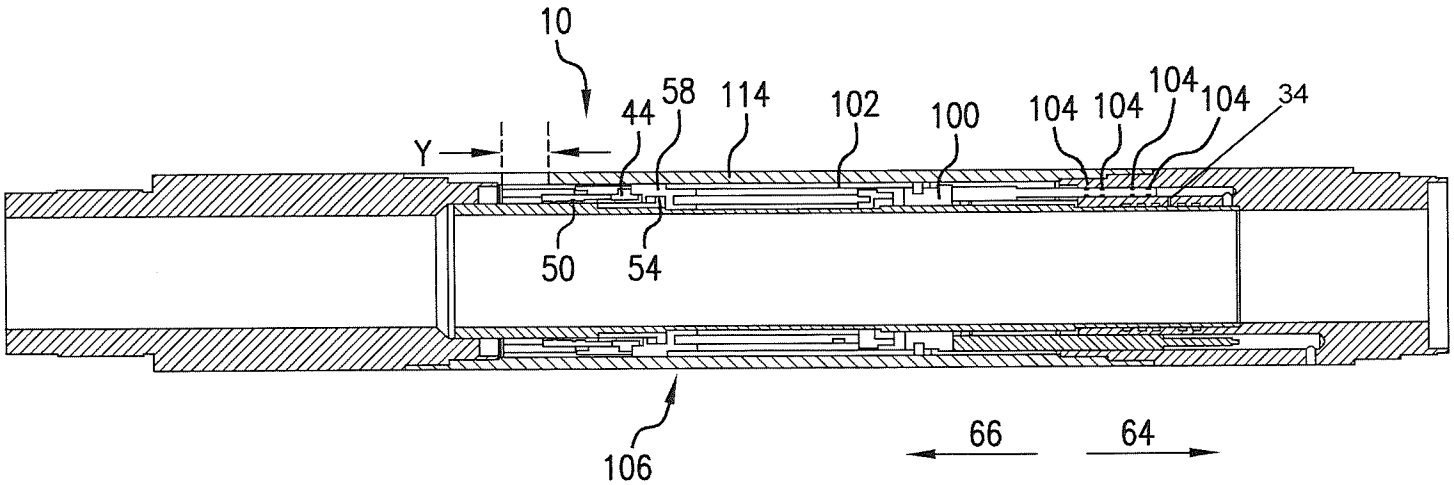
Figure 5A:
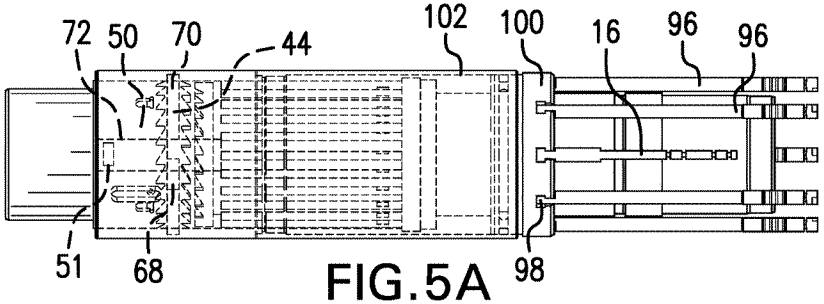
FIGS. 5A-5D depict a side view of portions of the downhole tool actuation system during various pressure cycles.
Figure 5B:
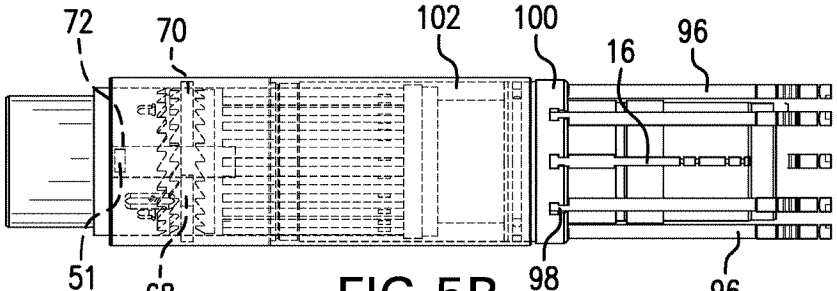
Figure 5C:
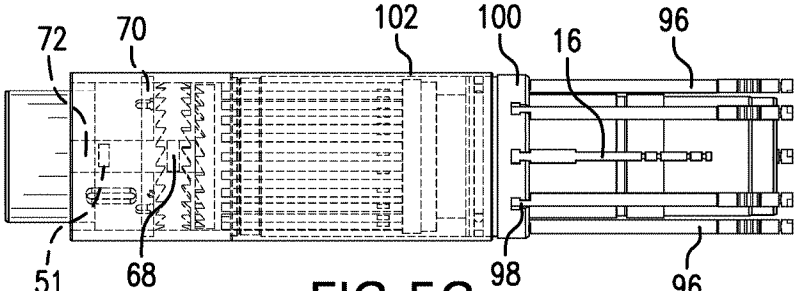
Figure 5D:
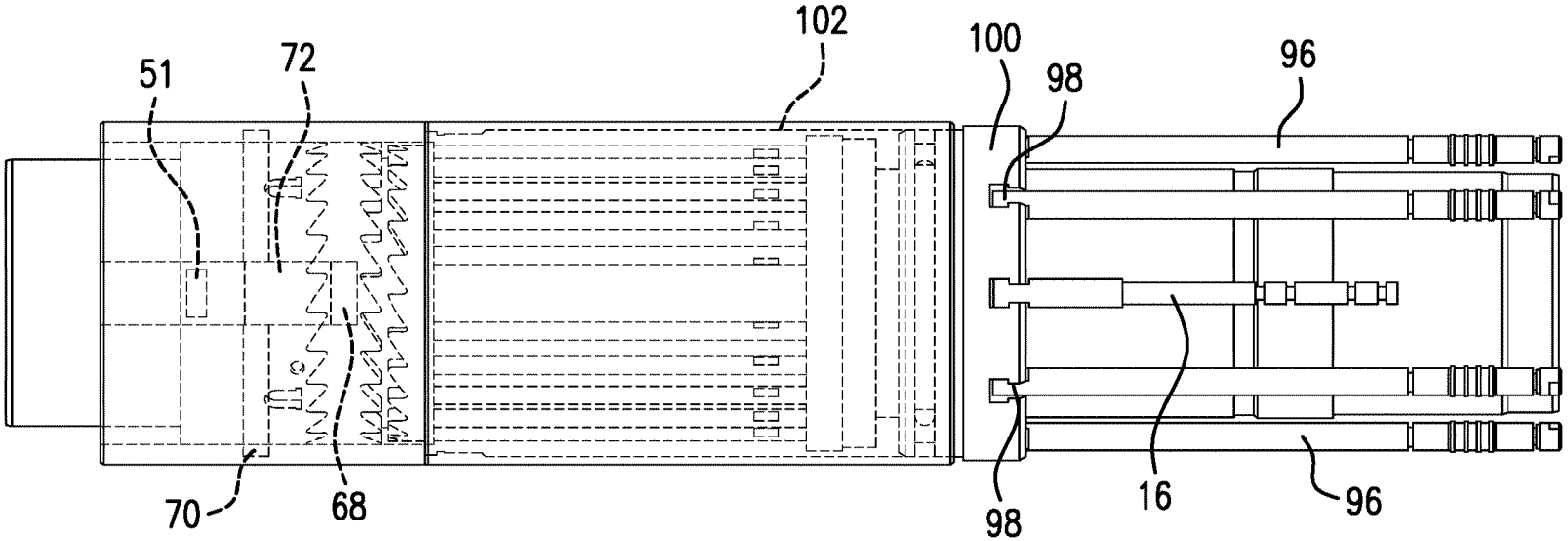

FIGS. 4A and 5A depict an initial condition of the system 10, where the rotatable ratchet 44 is in engagement with the first fixed ratchet 50, and held there by the spring(s) 74. In this initial condition, the port isolation device 16 is in a blocking condition such that tubing or hydrostatic pressure is not accessible to the fluidic passageway 94 to the chamber 18. Then, with reference to FIGS. 4B and 5B, tubing pressure, such as may be used to set a packer (not shown) or perform some other downhole function uphole of the system 10, will act on the seals located on the piston rods 96, pushing the piston rods 96, piston ring 100 and port isolation device 16 in the downhole direction 64, due to the higher differential pressure in the tubing compared to the annulus. Which due to the attached spring housing 102 and attached ratchet housing 58, puts the spring(s) 74 in compression via the ratchet housing 58, and also pulls the rotatable ratchet 44 into engagement with the second fixed ratchet 54. The rotatable ratchet 44 rotates due to the ratcheting faces 48, 56 of the rotatable ratchet 44 and second fixed ratchet 54. Although the port isolation device 16 has moved longitudinally, the port isolation device 16 is still in a blocking condition with respect to the fluidic passageway 94. And then, with reference to FIGS. 4C and 5C, when pressure is bled off, such as when an uphole packer has been set or another operation uphole of the system 10 has been accomplished using the pressure, the spring(s) 74 are allowed to de-compress, so the springs) 74 push the ratchet housing 58 back in the uphole direction 66 to bring the rotatable ratchet 44 back into contact with the first fixed ratchet 50 and rotate again within the circumferential groove 70, thus completing one cycle for the indexing mechanism 14. Thus, an operator is able to apply pressure in the tubing 12 without operating the downhole tool 20, such as without opening the ball valve 28 or sleeve valve 30. That is, port isolation device 16 remains in the blocking condition throughout the cycle. This process is repeated for as many pressure-up cycles as the indexing mechanism 14 is allotted. The system 10 can be provided to accommodate varying numbers of cycles. For example, if an operator intends to utilize a string 38 that will require a certain number of pressure-up cycles due to a number of downhole tools and operations that will require pressure actuation before actuation of the downhole tool 20, then a system 10 having the appropriate number of blocking cycles will be added to the string. At the end of the Nth cycle, as shown in FIGS. 4D and 5D, the lug 68 on the rotatable ratchet 44 has rotated into alignment with the longitudinal groove 72 and upon bleeding of the tubing pressure, the spring(s) 74 have biased the ratchet housing 58 the second distance Y and the piston ring 100, via movement of the ratchet housing 58 and spring housing 102, pulls the port isolation device 16 from the port isolation aperture 92 to reveal the port 34 and expose the fluidic passageway 94 to tubing pressure.

Thus, as shown in FIG. 1B, the downhole tool 20 is actuated when the port isolation device 16 is in the actuation condition. In the illustrated embodiment, the chamber 18 is exposed to tubing and hydrostatic pressure. A first end of the hydrostatic piston 26 is in fluid communication with the chamber 18. When tubing pressure enters the chamber 18 it acts on the hydrostatic piston 26 and forces it to move in the downhole direction 64. As the hydrostatic piston 26 moves, it may contact a shifting latch 120 and force it to move downhole as well. When the shifting latch 120 is moved down, the ball in the ball valve 28 is opened. In the embodiment where the ball valve 28 is the downhole tool 20, when the ball valve 28 is in the closed condition shown in FIG. 1A, the closed ball valve 28 can be used to pressure up against during the pressure cycles. While a particular embodiment of a valve 28 is shown in FIGS. 1A and 1B, other downhole tools 20 that are operable using hydraulic actuation are alternatively incorporable within the downhole system 10. One such alternative embodiment is the sleeve valve 30 shown in FIG. 11. The sleeve valve 30 is longitudinally shiftable within the tubing string 38 to move from a closed condition which blocks an interior and main flowbore 24 of the tubing 12 from fluidically communicating with one or more flow ports 122, to an open condition where the one or more flow ports 122 are exposed, thus allowing fluid communication between the interior and main flowbore 24 of the tubing 12 and a wellbore annulus 124. The sleeve valve 30 is longitudinally shiftable using tubing pressure provided to the chamber 18 as previously described. Other alternatives of downhole tools 20, including any that can be hydraulically actuated, may be operated by the hydraulic module 106 of the system 10.

Figure 6A:
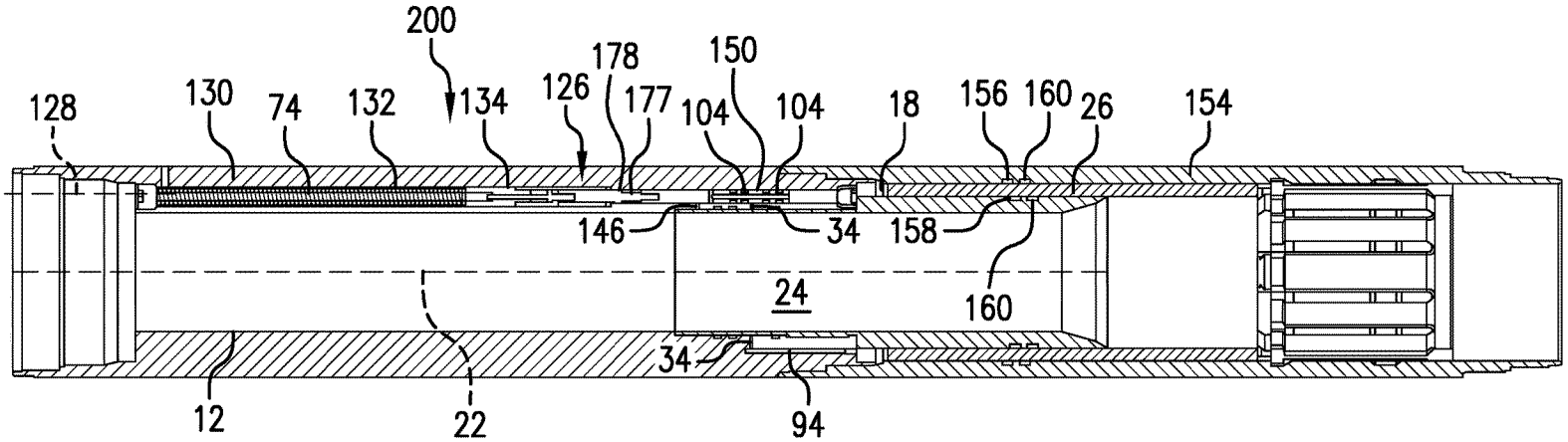
FIGS. 6A-6B depict another embodiment of portions of a downhole tool actuation system during various pressure cycles.

While the hydraulic module 106 of FIGS. 1A to 3D, and in particular the indexing apparatus 14, surrounds the main flowbore 24 of the tubing 12, and shares the longitudinal axis 22 with the tubing 12, in an alternative embodiment, with reference to FIGS. 6A to 10, a hydraulic module 126 of a downhole tool actuation system 200 may alternatively be formed as a module having a longitudinal axis 128 offset from the longitudinal axis 22 of the tubing 12. While the hydraulic module 126 performs the same function as the hydraulic module 106, the hydraulic module 126 is significantly smaller than the hydraulic module 106. The hydraulic module 126 does not require full bore parts. The system 200 of FIGS. 6A to 10 includes a system sub 130 having a receiving bore 132 for the hydraulic module 126, as well as having a fluidic passageway 94 for communicating tubing pressure in the receiving bore 132 with the isolated chamber 18. The sub 130 itself may form part of the tubing 12, as a main bore in the sub 130 shares the longitudinal axis 22 of the main flowbore 24 and flowpath of the tubing string 38. As in the previous embodiments, the chamber 18 is isolated from tubing pressure, as shown in FIG. 6A, until the Nth cycle of the indexing mechanism 134 when it is time to set the tool 20. Once the chamber 18 starts filling with higher pressure fluid from the tubing 12 and expands, the piston 26 will move in the downhole direction 64, as shown in FIG. 6B. The piston 26 will in turn actuate the downhole tool 20 directly, or by contacting one or more mechanical interconnections to actuate the tool 20.

Figure 7:
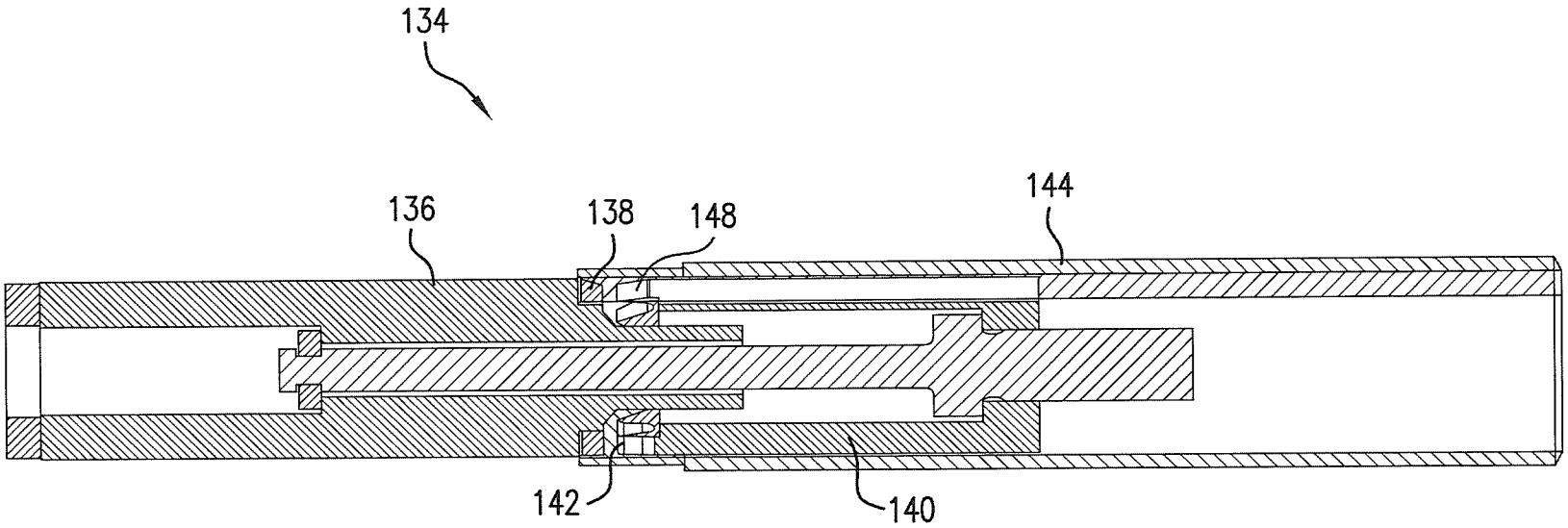
FIG. 7 depicts a sectional view of an embodiment of an indexing mechanism for the downhole tool actuation system of FIGS. 6A-6B.

Also as in the previous embodiment, the hydraulic module 126 still enables an operator to put N−1 cycles of pressure in the tubing 12 prior to uncovering a port 34 that allows pressure to enter the chamber 18. The hydraulic module 126 includes a biasing device, such as a spring 74, that biases an indexing mechanism 134 in the downhole direction 64. The indexing mechanism 134, as additionally shown in FIGS. 7 and 8A-8C, includes a first ratchet 136 having a first ratchet face 138, and a second ratchet 140 having a second ratchet face 142. A ratchet housing 144 remains stationary while the first ratchet 136 biases into engagement with the second ratchet 140. The hydraulic module 126 is in fluidic communication with the interior and main flowbore 24 of the tubing 12, through a radial port 146 that connects an interior of the sub 130 to an interior of the receiving bore 132, and when tubing pressure is increased in the tubing 12, the spring 74 gets compressed due to uphole movement of the second ratchet 140, pushing the first ratchet 136 past an interior lug 148 on the ratchet housing 148 for a first distance (see FIG. 7), allowing the first ratchet 136 to rotate due to rotational force applied by the second ratchet 140. When pressure is bled off, the spring 74 biases the first ratchet 136 to move it back downhole to re-engage with the interior lug 148 on the ratchet housing 144 which forces it to rotate again to complete a cycle (see FIG. 8A). Rotation of the first ratchet 136 with respect to the second ratchet 140 occurs due to engagement of the first and second ratchet faces 138, 142 and the first ratchet 136 and the interior lug 148 on the ratchet housing 144. The first and second ratchets 136, 142 may both be capable of some longitudinal movement, up to the first distance, during the engagement, however longitudinal movement within the ratchet housing 144 is limited due to a restrainment device such as a lug 148 (FIG. 7).

During the N−1 cycles, a port isolation device 150 (in the shape of a port isolation piston/mandrel) is connected to the first ratchet 136 and moves the limited longitudinal first distance with the first ratchet 136, but remains in a blocking condition to block the port 34 which is in fluidic communication with the chamber 18. The port 34 may be part of the fluidic passageway 94, which further includes a longitudinal path that extends through the sub 130. On the Nth cycle, the port isolation device 150 strokes a second distance further than the first distance such that the tubing pressure is communicable with the chamber 18 via the fluidic passageway 94. In one embodiment, the fluidic passageway 94 may further extend through an interior of the port isolation device 150. The first (uphole) port 146 communicates tubing pressure to the indexing mechanism 134, to act on a seal 177 located on a piston rod 178 to compress the spring 74 and complete the initial pressure cycle sequence. When pressure bleeds off, the indexing mechanism 134 returns to initial position, unless N number of cycles have occurred, in which case the spring 74 will push the isolation device 150 further within the receiving bore 132, exposing the second (downhole) port 34 to communicate the main flowbore 24 with the fluidic passageway 94. Between the first and second ports 146, 34, one or more grooves provide a location for O-ring seals with back up rings to prevent pressure from getting into the second port 34. Thus, the tubing pressure will enter through the first port 146 instead of the second port 34 for all cycles but the Nth cycle.

Figure 8A:
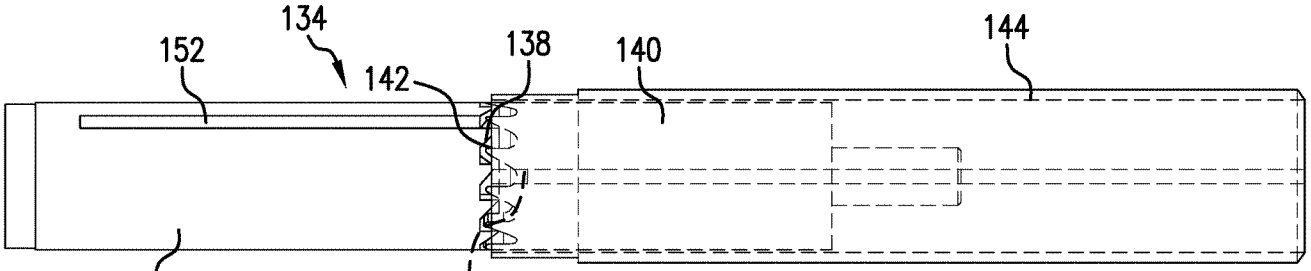
FIGS. 8A-8C depict side views of the indexing mechanism of FIG. 7 during various pressure cycles.
Figure 8B:
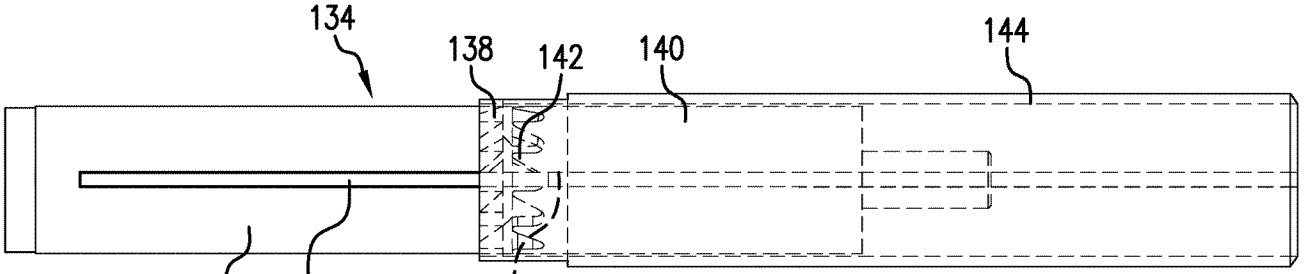
Figure 8C:
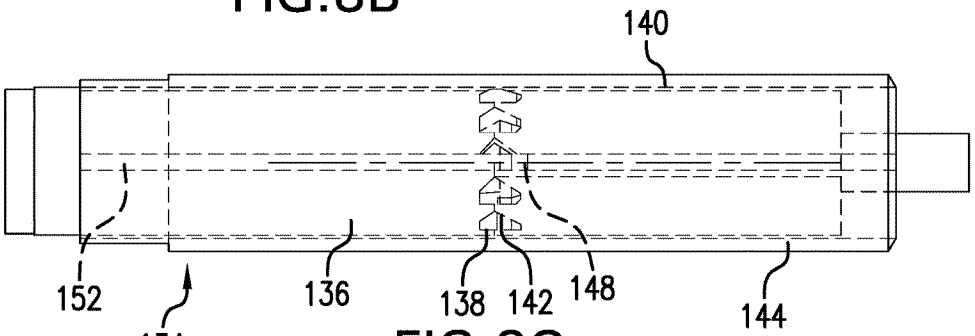

The lug 148 prohibits the first ratchet 136 from moving further than the first distance into the ratchet housing 144, and prevents the isolation device 150 from fluidically communicating the tubing pressure to the chamber 18. The lug 148 is provided on an inner surface of the ratchet housing 144 and prevents the first ratchet 136 from further movement in the downhole direction 64. For N−1 cycles, the lug 148 prevents the first ratchet 136 from moving the second distance longitudinally into the ratchet housing 144, because a longitudinal groove or slot 152 in the first ratchet 136 is not aligned with the lug 148. The lug 148 forces the first ratchet 136 to stay in its position because when the first ratchet 136 tries to move in the downhole direction 64, it hits the lug 148 and is blocked from further movement, as shown in FIG. 8A. As the tubing pressure is increased, the tubing pressure forces the first ratchet 136 to rotate around the longitudinal axis 128 of the indexing mechanism 134 because of the cooperating angled faces 138, 142 on the first and second ratchets 136, 140. The spring 74 pushes the first ratchet 136 in place on the second ratchet 140 to complete each cycle. On the Nth cycle, as the pressure is bled out of the tubing 12, and thus out of the hydraulic module 126, the lug 148 will not shoulder out on the first ratchet 136 anymore. Instead, the lug 148 on the ratchet housing 144 aligns with the slot 152 in the first ratchet 136, allowing the first ratchet 136, as well as the second ratchet 140 and attached connecting flanges to move in the downhole direction 64 (by biasing spring 74) with respect to ratchet housing 144, correspondingly moving the port isolation device 150 to expose the second port 34 and communicate the tubing pressure to the chamber 18. Increased pressure in the chamber 18 acts on the piston 26 (FIGS. 6A and 6B) within the piston housing 154. The piston 26 may be a balanced piston, having a substantially same diameter across. Grooves 156, 158 with seals 160 may be provided to create a seal on both inner and outer radial sides of the piston 26 so that when the pressure enters the chamber 18, all or at least substantially all of the pressure in the chamber 18 will act on the piston 26 pushing it downhole to actuate the tool 20 (see FIGS. 1A, 1B, and 11), such as opening a valve or setting a tool.

Figure 6B:
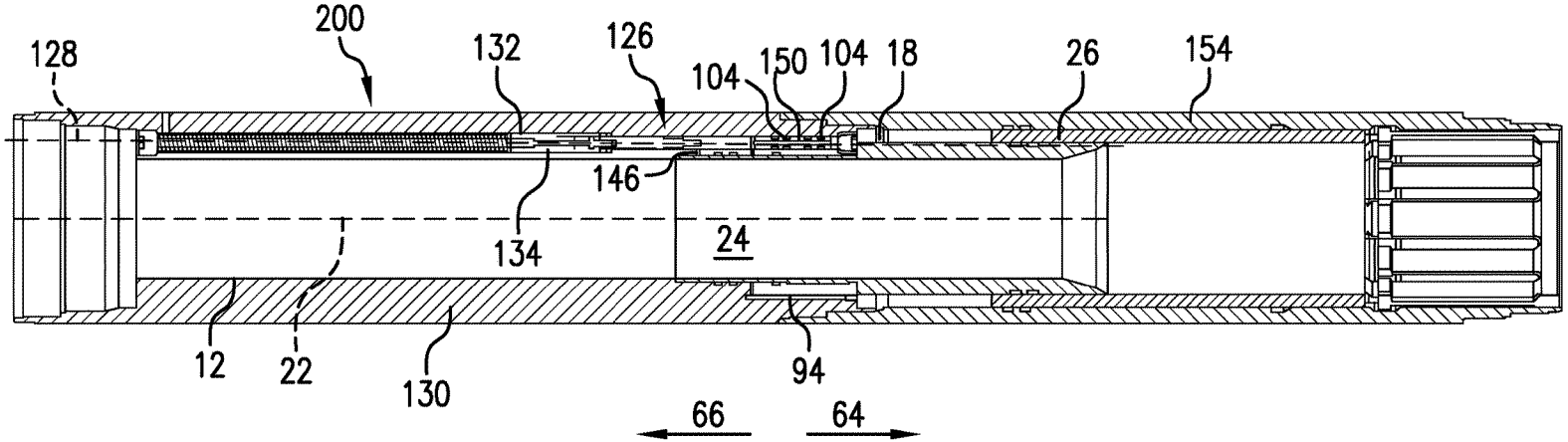
Figure 9:
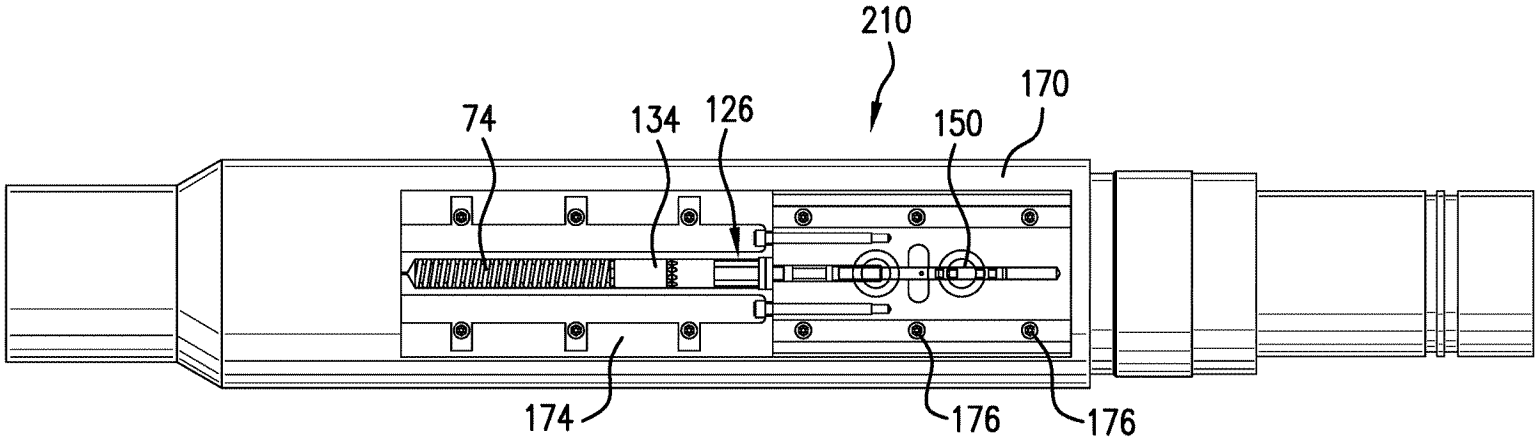
FIG. 9 depicts a plan view of another embodiment of portions of a downhole tool actuation system.
Figure 10:
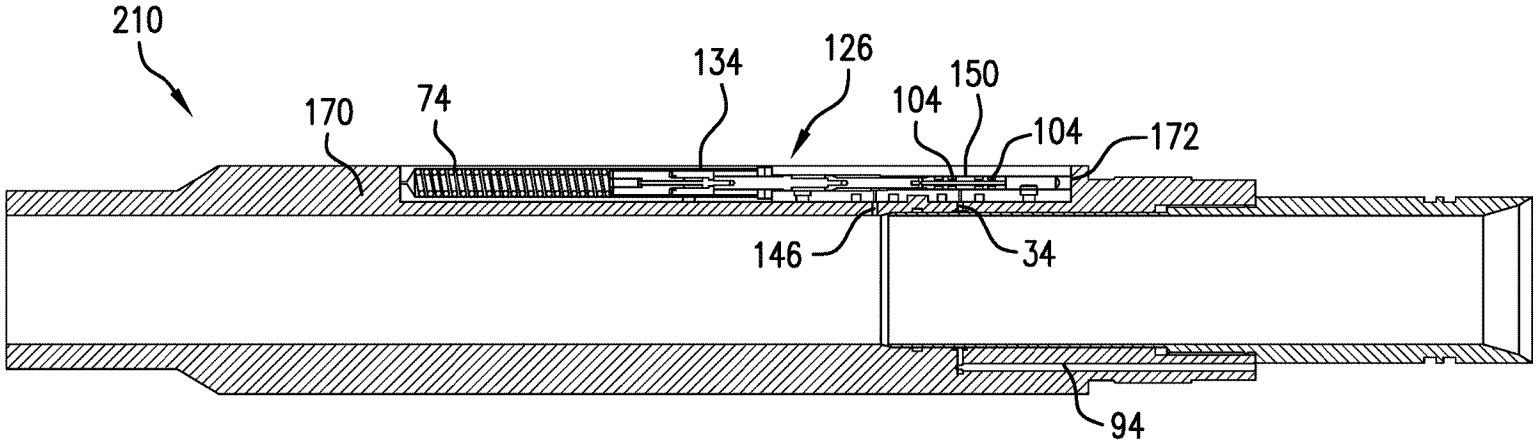
FIG. 10 depicts a sectional view of the downhole tool actuation system of FIG. 9.

An alternative embodiment of a downhole tool actuation system 210, similar to the system 200 shown in FIGS. 6A-6B, is shown in FIGS. 9 and 10. In lieu of the receiving bore 132 for the hydraulic module 126 of the system 200, the system 210 includes a "bolt on" modular design for the hydraulic module 126. The system 210 includes a sub 170 having a receiving area 172 for receiving the hydraulic module 126. The hydraulic module 126 may be supported by supporting structure 174 that is received on and securable to the receiving area 172, such as by securement devices 176 such as, but not limited to, bolts and screws. When the supporting structure 174 is secured to the sub 170, the hydraulic module 126 is automatically aligned with the first and second ports 146, 34 as needed to operate the system 210. The system 210 functions substantially the same as in the previous embodiments, by indexing with applied pressure until the port isolation device 150 is moved out of position, uncovering the port 34 and fluidic passageway 94 to the chamber 18.

In an embodiment where the downhole tool 20 is a ball valve 28, such as shown in FIGS. 1A and 1B, the ball valve 28 can be provided in a lower completion and closed (FIG. 1A) which will isolate annular reservoir pressure from the tubing 12 above the closed ball, allowing the operator to install the upper completion of the well. The operators can apply pressure to the tubing string 38 to install the upper completion without opening the ball valve 28 prematurely because the indexing mechanism 14 allows N−1 pressure cycles, to be applied in the tubing string 38 before the ball valve 28 is opened. When they apply the Nth pressure cycle, then the indexing mechanism 14 will stroke down further which will allow the tubing pressure to enter the sealed chamber 18 which will then open the ball valve 28.

The method of isolating the chamber 18 with a sealed port isolation device 16 in conjunction with the indexing mechanism 14 advantageously allows the operator to apply tubing pressure to the work string 38 without immediately or inadvertently activating the tool 20. With this system 10, 200, 210, a number (N−1) of pressure cycles can be applied without activating the tool 20. This method advantageously provides a mechanical trigger that is not time sensitive, as opposed to electronic modules to uncover a port 34 to a chamber 18. Using electronics in wellbores with high temperatures and pressures may be subject to failure due to short battery life over relatively short periods of time. This method advantageously does not rely on materials that dissolve when exposed to wellbore fluids which can be time sensitive. This method may also be more reliable than systems which must break or rupture pressure containing discs due, because less force is required to shuttle the port isolation device 16 than would be required to break the disc. This method further advantageously utilizes tubing pressure from within the tubing 12, which is controlled from surface, and which will enter the chamber 18 and energize the piston 26, as opposed to employing reservoir pressure (exterior of the tubing) from the annulus 124 which is an estimated and uncontrollable pressure. The system 10, 200, 210 which uses hydrostatic pressure as an actuating force may further be less costly than devices that utilize spring based actuators, which can be costly.

Set forth below are some embodiments of the foregoing disclosure:

Embodiment 1

A downhole tool actuation system including: a tubing having a longitudinal axis and a main flowbore supportive of tubing pressure; an indexing mechanism in fluidic communication with the main flowbore, the indexing mechanism configured to count N number of tubing pressure cycles; a port isolation device movable between a blocking condition and an actuation condition, the port isolation device in the blocking condition for N−1 cycles of the indexing mechanism, and movable to the actuation condition at the Nth cycle of the indexing mechanism; and, a chamber sealed from the main flowbore in the blocking condition of the port isolation device, the chamber exposed to the tubing pressure in the actuation condition of the port isolation device; wherein the downhole tool actuation system is configured to actuate a downhole tool upon exposure of the chamber to tubing pressure.

Embodiment 2

The downhole tool actuation system of any of the preceding embodiments, further including a hydrostatic piston and the downhole tool, wherein the hydrostatic piston is moved longitudinally to actuate the downhole tool upon exposure of the chamber to tubing pressure.

Embodiment 3

The downhole tool actuation system of any of the preceding embodiments, wherein the downhole tool is a ball valve.

Embodiment 4

The downhole tool actuation system of any of the preceding embodiments, wherein the downhole tool is a sliding sleeve.

Embodiment 5

The downhole tool actuation system of any of the preceding embodiments, wherein the indexing mechanism is longitudinally movable at least a first distance during the N−1 cycles of the indexing mechanism, and longitudinally movable a second distance during the Nth cycle, the second distance greater than the first distance.

Embodiment 6

The downhole tool actuation system of any of the preceding embodiments, wherein the indexing mechanism includes a biasing member and a restrainment device, the restrainment device preventing the indexing mechanism from moving the second distance during the N−1 cycles, and the biasing member biasing the indexing mechanism to move the second distance during the Nth cycle.

Embodiment 7

The downhole tool actuation system of any of the preceding embodiments, wherein the restrainment device is a lug, the indexing mechanism further includes a longitudinal slot, the lug and the slot are misaligned during the N−1 cycles, and the lug and the slot are aligned during the Nth cycle.

Embodiment 8

The downhole tool actuation system of any of the preceding embodiments, further including a biasing mechanism, wherein, during the N−1 cycles, the port isolation device is movable from a first position to a second position upon an increase in tubing pressure, and the port isolation device is returned to the first position by the biasing mechanism after a decrease in tubing pressure, the port isolation device in the blocking condition in both the first and second positions, and, during the Nth cycle, the port isolation device is moved to a third position by the biasing mechanism, the third position corresponding to the actuation condition.

Embodiment 9

The downhole tool actuation system of any of the preceding embodiments, wherein the indexing mechanism includes a rotatable counting portion rotatable with respect to the longitudinal axis.

Embodiment 10

The downhole tool actuation system of any of the preceding embodiments, wherein the indexing mechanism includes a ratcheting arrangement, the ratcheting arrangement including a first ratcheting face rotatable with respect to a second ratcheting face.

Embodiment 11

The downhole tool actuation system of any of the preceding embodiments, wherein the chamber is isolated from pressure exterior of the downhole tool actuation system in both the blocking condition and the actuation condition of the port isolation device.

Embodiment 12

The downhole tool actuation system of any of the preceding embodiments, wherein the port isolation device is movable within a port isolation aperture, and further including a fluidic passageway between the port isolation aperture and the chamber, the blocking condition of the port isolation device blocking fluidic communication to the fluidic passageway, and the actuation condition of the port isolation device exposing the fluidic passageway to tubing pressure.

Embodiment 13

The downhole tool actuation system of any of the preceding embodiments, wherein the fluidic passageway is isolated from annulus pressure in both the blocking condition and the actuation condition of the port isolation device.

Embodiment 14

The downhole tool actuation system of any of the preceding embodiments, further including a port isolation sub having a wall, an aperture extending longitudinally through a thickness of the wall, the port isolation device movably disposed within the aperture, a radial port connecting the main flowbore to the aperture, and a fluidic passageway connecting the chamber to the aperture.

Embodiment 15

The downhole tool actuation system of any of the preceding embodiments, further including at least two seals surrounding the port isolation device, wherein at least one seal is disposed uphole the radial port and at least one seal is disposed downhole the radial port in the blocked condition of the port isolation device, and the at least two seals are positioned on a same side of the radial port in the actuation condition of the port isolation device.

Embodiment 16

The downhole tool actuation system of any of the preceding embodiments, wherein the indexing mechanism is concentric with the tubing.

Embodiment 17

The downhole tool actuation system of any of the preceding embodiments, wherein the indexing mechanism has a longitudinal axis offset from the longitudinal axis of the tubing.

Embodiment 18

The downhole tool actuation system of any of the preceding embodiments, wherein the indexing mechanism and port isolation device are disposed within a modular package securable to an exterior of the tubing.

Embodiment 19

A method of actuating a downhole tool associated with a tubing, the method including: arranging the downhole tool in operative engagement with a chamber; isolating the chamber from tubing pressure for N−1 pressure cycles in the tubing; and, during an Nth pressure cycle in the tubing, exposing the chamber to tubing pressure, wherein exposure of the chamber to tubing pressure is configured to actuate the downhole tool.

Embodiment 20

The method of any of the preceding embodiments, further including utilizing an indexing mechanism in fluidic communication with the tubing to count tubing pressure cycles.

Embodiment 21

The method of any of the preceding embodiments, wherein utilizing the indexing mechanism includes biasing a first ratcheting face into ratcheting engagement with a second ratcheting face.

Embodiment 22

The method of any of the preceding embodiments, further including utilizing a port isolation device movable between a blocking condition and an actuation condition, the blocking condition blocking the chamber from receiving tubing pressure for N−1 cycles of the indexing mechanism, and the actuation condition exposing the chamber to tubing pressure at the Nth cycle of the indexing mechanism.

Embodiment 23

The method of any of the preceding embodiments, further including moving a hydrostatic piston longitudinally with tubing pressure in the chamber to actuate the downhole tool upon exposure of the chamber to tubing pressure in the Nth cycle.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool actuation system comprising:

a tubing having a longitudinal axis and a main flowbore supportive of tubing pressure;

an indexing mechanism in fluidic communication with the main flowbore, the indexing mechanism configured to count N number of tubing pressure cycles;

a biasing mechanism;

a port isolation device movable between a blocking condition and an actuation condition, the port isolation device movable from a first position to a second position upon an increase in tubing pressure, and the port isolation device returnable to the first position by the biasing mechanism after a decrease in tubing pressure, the port isolation device in the blocking condition in both the first and second positions for N−1 cycles of the indexing mechanism, and at an end of the Nth cycle of the indexing mechanism, the port isolation device is movable to a third position by the biasing mechanism after a decrease in tubing pressure, the third position corresponding to the actuation condition; and, a chamber sealed from the main flowbore in the blocking condition of the port isolation device, the chamber exposed to the tubing pressure in the actuation condition of the port isolation device;

wherein the downhole tool actuation system is configured to actuate a downhole tool upon exposure of the chamber to tubing pressure.

2. The downhole tool actuation system of claim 1, further comprising a hydrostatic piston and the downhole tool, wherein the hydrostatic piston is moved longitudinally to actuate the downhole tool upon exposure of the chamber to tubing pressure.

3. The downhole tool actuation system of claim 2, wherein the downhole tool is a ball valve.

4. The downhole tool actuation system of claim 2, wherein the downhole tool is a sliding sleeve.

5. The downhole tool actuation system of claim 1, wherein the indexing mechanism is longitudinally movable at least a first distance during the N−1 cycles of the indexing mechanism, and longitudinally movable a second distance during the Nth cycle, the second distance greater than the first distance.

6. The downhole tool actuation system of claim 5, wherein the indexing mechanism includes a restrainment device, the restrainment device preventing the indexing mechanism from moving the second distance during the N−1 cycles, and the biasing member biasing the indexing mechanism to move the second distance during the Nth cycle.

7. The downhole tool actuation system of claim 6, wherein the restrainment device is a lug, the indexing mechanism further includes a longitudinal slot, the lug and the slot are misaligned during the N−1 cycles, and the lug and the slot are aligned during the Nth cycle.

8. The downhole tool actuation system of claim 1, wherein the indexing mechanism includes a rotatable counting portion rotatable with respect to the longitudinal axis.

9. The downhole tool actuation system of claim 1, wherein the indexing mechanism includes a ratcheting arrangement, the ratcheting arrangement including a first ratcheting face rotatable with respect to a second ratchetting face.

10. The downhole tool actuation system of claim 1, wherein the chamber is isolated from pressure exterior of the downhole tool actuation system in both the blocking condition and the actuation condition of the port isolation device.

11. The downhole tool actuation system of claim 1, wherein the port isolation device is movable within a port isolation aperture, and further comprising a fluidic passageway between the port isolation aperture and the chamber, the blocking condition of the port isolation device blocking fluidic communication to the fluidic passageway, and the actuation condition of the port isolation device exposing the fluidic passageway to tubing pressure.

12. The downhole tool actuation system of claim 11, wherein the fluidic passageway is isolated from annulus pressure in both the blocking condition and the actuation condition of the port isolation device.

13. The downhole tool actuation system of claim 1, further comprising a port isolation sub having a wall, an aperture extending longitudinally through a thickness of the wall, the port isolation device movably disposed within the aperture, a radial port connecting the main flowbore to the aperture, and a fluidic passageway connecting the chamber to the aperture.

14. The downhole tool actuation system of claim 13, further comprising at least two seals surrounding the port isolation device, wherein at least one seal is disposed uphole relative to the radial port and at least one seal is disposed downhole relative to the radial port in the blocked condition of the port isolation device, and the at least two seals are positioned on a same side of the radial port in the actuation condition of the port isolation device.

15. The downhole tool actuation system of claim 1, wherein the indexing mechanism is concentric with the tubing.

16. The downhole tool actuation system of claim 1, wherein the indexing mechanism has a longitudinal axis offset from the longitudinal axis of the tubing.

17. The downhole tool actuation system of claim 16, wherein the indexing mechanism and port isolation device are disposed within a modular package securable to an exterior of the tubing.

18. A method of actuating the downhole tool associated with the tubing using the downhole tool actuation system of claim 1, the method comprising:

isolating the chamber from tubing pressure for N−1 pressure cycles in the tubing; and, during the Nth pressure cycle in the tubing, exposing the chamber to tubing pressure, wherein exposure of the chamber to tubing pressure is configured to actuate the downhole tool.

19. The method of claim 18, further comprising utilizing the indexing mechanism in fluidic communication with the tubing to count tubing pressure cycles.

20. The method of claim 19, wherein utilizing the indexing mechanism includes biasing a first ratcheting face into ratcheting engagement with a second ratcheting face.

21. The method of claim 19, further comprising utilizing the port isolation device movable between the blocking condition and the actuation condition.

22. The method of claim 18, further comprising moving a hydrostatic piston longitudinally with tubing pressure in the chamber to actuate the downhole tool upon exposure of the chamber to tubing pressure in the Nth cycle.

* * * * *